US008162554B2

(12) United States Patent
Furukawa et al.

(10) Patent No.: US 8,162,554 B2
(45) Date of Patent: Apr. 24, 2012

(54) WRITING IMPLEMENT

(75) Inventors: Kazuhiko Furukawa, Kanagawa (JP); Masanobu Kiritake, Kanagawa (JP); Kengo Nagaoka, Kanagawa (JP)

(73) Assignee: Mitsubishi Pencil Company Limited, Tokyo (JP)

( * ) Notice: Subject to any disclaimer, the term of this patent is extended or adjusted under 35 U.S.C. 154(b) by 115 days.

(21) Appl. No.: 12/449,055

(22) PCT Filed: Nov. 29, 2007

(86) PCT No.: PCT/JP2007/073068

§ 371 (c)(1),
(2), (4) Date: Jul. 22, 2009

(87) PCT Pub. No.: WO2008/090679

PCT Pub. Date: Jul. 31, 2008

(65) Prior Publication Data

US 2010/0104347 A1 Apr. 29, 2010

(30) Foreign Application Priority Data

Jan. 23, 2007 (JP) ..... 2007-012666

(51) Int. Cl.
*B43K 7/12* (2006.01)

(52) U.S. Cl. ..... 401/112; 401/109

(58) Field of Classification Search ..... 401/104–106, 401/109–112, 117, 209, 214, 216
See application file for complete search history.

(56) References Cited

U.S. PATENT DOCUMENTS

| | | | | |
|---|---|---|---|---|
| 4,544,297 | A | 10/1985 | Grossiord | 401/217 |
| 5,915,866 | A * | 6/1999 | Furukawa | 401/106 |
| 6,336,761 | B1 * | 1/2002 | Kudo | 401/106 |
| 6,729,787 | B2 * | 5/2004 | Usami et al. | 401/141 |
| 7,303,349 | B2 * | 12/2007 | Murakoshi | 401/188 A |

FOREIGN PATENT DOCUMENTS

| | | | |
|---|---|---|---|
| EP | 0 113 274 | A1 | 7/1984 |
| JP | 59-136296 | A | 8/1984 |
| JP | 1-280597 | A | 11/1989 |
| JP | 2000-335173 | A | 12/2000 |
| JP | 2005-131942 | A | 5/2005 |

* cited by examiner

*Primary Examiner* — David J. Walczak
*Assistant Examiner* — Jennifer C Chiang
(74) *Attorney, Agent, or Firm* — Kubovcik & Kubovcik

(57) ABSTRACT

A writing implement is provided including a knock mechanism, in which, without obstruction of normal operation, impact can be cushioned by a damper space that is sealed off from the outside. The writing implement (10) including the knock mechanism capable of advancing a writing tip (11) by push-out operation, includes: a holding section (12) for holding the writing tip (11); a shaft tube (20) for containing the holding section (12); a knock section (30) for covering a rear end portion of the shaft tube (20); a push-out section (13) for pressing the holding section (12) toward a front end in operative association with push-out operation of the knock section (30); and the damper space (40) provided between the knock section (30) and the shaft tube (20), being sealed off from the outside, and changing its volume by push-out operation of the knock section (30).

3 Claims, 16 Drawing Sheets

WRITING IMPLEMENT

TECHNICAL FIELD

The present invention relates to a writing implement such as a ballpoint pen, etc., including a writing tip protruded and retracted by push-out operation of a knock section at a rear end, or a writing implement such as a mechanical pencil, etc., with lead advanced by push-out operation of a knock section.

BACKGROUND ART

Conventionally, writing implements, particularly ballpoint pens that are formed so that a writing tip is protruded and retracted by push-out operation of a knock section provided at a rear end have been widely used. Moreover, mechanical pencils with lead advanced from a front end by push-out operation of a similar knock section have been also widely used.

In such a retractable writing implement, an elastic member such as a spring is used as a component in a knock mechanism. Then, for a ballpoint pen, for example, when a knock section is pressed in a direction against a biasing force of the elastic member, a push-out section connected to the knock section pushes out a writing tip, which is in turn protruded from a front end for a writable state. At this time, with the elastic member compressed, the push-out section usually remains in a push-out position by a lock mechanism and is disconnected from the knock section. Thus, the knock section is free in the writable state, and is moved toward a front end by gravity when the writing tip points downward and moved toward a rear end when the writing tip points upward.

Then, when the knock section is again pressed, the lock mechanism is released, the writing tip is retracted by return of the elastic member by its biasing force, and the push-out section presses the knock section rearward and returns the knock section to its original position.

For such a knock mechanism, after the knock section is pressed to return the writing tip to its original position, the knock mechanism sometimes vigorously hits a rear end or the like of a shaft tube containing the knock mechanism by a return force of the elastic member. If this repeatedly occurs, damage may be caused by elastic fatigue, or an impact may propagate to a refill to cause ill effects such as thin drawing lines for a ballpoint pen. Moreover, with a strong return force of the elastic member, vibration may propagate to a user's hand to provide uncomfortable feeling to the user.

The invention described in Patent Document 1 in which an air-damper mechanism by air resistance is applied in a part of a knock mechanism is a conventional technique to solve such problems.

Further, the invention described in Patent Document 2 in which a sealed space with respect to an ink-containing tube is obtained at the time of knocking and in which a mechanism that pressurizes the space is provided is also disclosed though its purpose is different.

Patent Document 1: JP 2005-131942 A

Patent Document 2: JP 2000-335173 A

DISCLOSURE OF THE INVENTION

In the invention described in Patent Document 1 above, the air-damper mechanism is provided to act against a return force of an elastic member to cushion a collision of the knock mechanism caused by return operation. However, the air-damper mechanism has an air hole through which air passes to and from the outside, and is thus not sealed off from the outside. Thus, too large an air hole may possibly completely prevent collision-cushioning action. On the other hand, too small an air hole may possibly completely prevent air from passing therethrough or significantly slow down the passage of air, leading to unsatisfactory return operation.

Thus, the present invention has an object to provide a writing implement including a knock mechanism, in which, without obstruction of normal operation, impact can be cushioned by a damper space that is sealed off from the outside.

(1) First Invention

To achieve the above-described object, a first invention of the present invention provides a writing implement including a knock mechanism capable of advancing a writing tip by push-out operation, comprising: a holding section for holding the writing tip; a shaft tube for containing the holding section; a knock section for covering a rear end portion of the shaft tube; a push-out section for pressing the holding section toward a front end in operative association with push-out operation of the knock section; and a damper space being provided between the knock section and the shaft tube and sealed off from the outside; volume of the damper space being changed by the push-out operation of the knock section.

The "writing tip" has a shape according to a type of the writing implement. It is, for example, a ballpoint pen tip holding a writing ball as to a ballpoint pen, or is a portion from which lead is advanced as to a mechanical pencil.

The "holding section" refers to a section for holding the writing tip, and is, for example, an ink refill to which a ballpoint pen tip is mounted as to a ballpoint pen. Moreover, a mechanism such as a chuck for directly advancing lead as to a mechanical pencil corresponds to the "holding section."

The "shaft tube" refers to a part containing the holding section including the writing tip, and generally to a structure forming an outermost layer of the writing implement. The shaft tube in the present invention includes an integrally formed structure and a structure constituted by two or more members combined, and also includes a structure covering the "shaft tube" in some cases.

The "knock section" refers to, for example, a so-called knock button or the like protruding from a rear end of a retractable ballpoint pen or a mechanical pencil.

The "push-out section" refers to a part located between the knock section and the holding section for transferring push-out operation of the knock section to the holding section.

The "damper space" refers to a space formed by sealing a clearance between the knock section and the shaft tube. This sealing requires a seal member for blocking passage of air for both of a part closer to a front end and a part closer to a rear end of the clearance between the knock section and the shaft tube.

The volume of the damper space may change either by increasing in one embodiment or by decreasing in another embodiment.

In the aspect of volume increase, the damper space is expanded along with the push-out operation of the knock section to reduce pressure in the space. Then when the push-out operation is undone, a force to increase the pressure in the space reduces the volume of the damper space and thus returns the knock section to its original position. Such an aspect can be attained by, for example, locating seal members that define a front and a rear of the damper space in such a positional relationship that the seal members are moved away from each other by the push-out operation of the knock section.

On the other hand, in the aspect of volume decrease, the damper space is compressed along with the push-out operation of the knock section to increase pressure in the space.

Then, when the push-out operation is undone, a force to reduce the pressure in the space increases the volume of the damper space and thus returns the knock section to its original position. Such an aspect can be attained by, for example, locating seal members that define a front and a rear of the damper space in such a positional relationship that the seal members are brought close to each other by the push-out operation of the knock section.

That is, in either aspect, the knock section maintains a fixed position by air pressure in the damper space while the push-out operation is not performed, irrespective of whether the writing tip is protruded or retracted. Moreover, when the knock section is returned from the push-out position to its original position, impact is cushioned by the air pressure in the damper space.

(2) Second Invention

As the aspect of volume decrease, a second invention of the present invention is characterized in that, in addition to the above-described features, the rear end portion of the shaft tube is formed as a reduced-diameter portion having a reduced outer diameter, the knock section is shaped to cover the rear end portion of the shaft tube, a front half portion of an inner space of the knock section is formed as a large-diameter portion having a larger inner diameter, a rear half portion of the inner space of the knock section is formed as a small-diameter portion having a smaller inner diameter, the push-out section is protruded from a rear end surface of the small-diameter portion of the knock section, the push-out section passes through the reduced-diameter portion to abut against the holding section, the inner diameter of the large-diameter portion is formed to be slightly larger than an outer diameter of a base portion which consists a front side portion of the shaft tube before the reduced-diameter portion, the inner diameter of the small-diameter portion is formed to be slightly larger than the outer diameter of the reduced-diameter portion of the shaft tube and smaller than the outer diameter of the base portion, a front-seal member that seals a clearance between the base portion and the large-diameter portion is mounted to an outer periphery of the base portion, a rear-seal member that seals a clearance between the reduced-diameter portion and the small-diameter portion is mounted to an outer periphery of the reduced-diameter portion, and a clearance between the large-diameter portion and the reduced-diameter portion is cut off from the outside by the front-seal member and the rear-seal member to form the damper space.

That is, when the knock section is pressed, a step between the large-diameter portion and the small-diameter portion of the knock section is brought close to a step between the reduced-diameter portion and the base portion of the shaft tube to reduce the volume of the damper space. At this time, a front end of the damper space is sealed by the front-seal member, and a rear end thereof is sealed by the rear-seal member, thereby allowing internal pressure to be increased without leakage of air in the damper space. This provides proper suspension feeling to a finger pressing the knock section.

Moreover, when the pressing of the knock section is released, the compressed damper space returns to its original size, and thus the knock section returns to a position before the pressing irrespective of whether the writing tip is protruded or retracted. In this return of the knock section, the damper space cushions the impact, thereby significantly reducing the possibility of failure of the knock mechanism.

(3) Third Invention

A third invention of the present invention is characterized in that, in addition to the feature of the second invention, at least one of the small-diameter portion and the large-diameter portion is formed as a tapered surface having a larger inner diameter on a front end side than that on a rear end side, and at least one of the rear-seal member and the front-seal member is brought into tight contact with a smaller diameter portion of the tapered surface by the push-out operation of the knock section.

Further, the third invention may include the following three aspects:

(3-1) A case where only the small-diameter portion is formed as the tapered surface. In this case, the damper space is sealed just after the rear-seal member is brought into tight contact with the small-diameter portion as the tapered surface by the push-out operation of the knock section.

(3-2) A case where only the large-diameter portion is formed as the tapered surface. In this case, the damper space is sealed just after the front-seal member is brought into tight contact with the large-diameter portion as the tapered surface by the push-out operation of the knock section.

(3-3) A case where both the small-diameter portion and the large-diameter portion are formed as the tapered surface. In this case, the damper space is sealed just after the rear-seal member is brought into tight contact with the small-diameter portion as the tapered surface and the front-seal member is brought into tight contact with the large-diameter portion as the tapered surface by the push-out operation of the knock section.

That is, at the time when the push-out operation begins, the rear-seal member or the front-seal member is not in contact with the small-diameter portion or the large-diameter portion of the knock section, and thus the damper space is not sealed. However, along with the push-out operation, the small-diameter portion or the large-diameter portion that has not been in contact with the rear-seal member or the front-seal member at first is brought into contact and finally brought into tight contact therewith, and thus the damper space is sealed. Further pressing from this state compresses air in the damper space.

With such a configuration, when the writing implement is not used, one or both of the seal members are not in contact with an inner wall of the knock section. This can prevent sticking of the seal members.

(4) Fourth Invention

A fourth invention of the present invention is characterized in that, in addition to the feature of the second invention, the knock section has an air hole that provides communication between the damper space and the outside when the push-out operation of the knock section is not performed, and the air hole is moved toward a front end side before the front-seal member by the push-out operation of the knock section, and thus the damper space is sealed off from the outside.

That is, at the time when the push-out operation begins, the damper space communicates with the outside through the air hole and is not sealed. However, along with the push-out operation, the air hole is moved forward before the front-seal member, and, at this time, the damper space is sealed. Further pressing in this state compresses air in the damper space.

(5) Fifth Invention

To achieve the above described object, a fifth invention of the present invention provides a writing implement including a knock mechanism capable of advancing a writing tip by push-out operation, comprising: a holding section for holding the writing tip; a shaft tube for containing the holding section; a knock section located at a rear end portion of the shaft tube; a push-out section for pressing the holding section toward a front end along with push-out operation of the knock section; and a damper space provided between the knock section and the push-out section and sealed off from the outside; volume of the damper space being reduced by the push-out operation of the knock section.

In the first invention, the damper space has only cushioning action in the push-out operation and the return operation of the knock section, and is not directly involved in protrusion and retraction of the writing tip. On the other hand, in the fifth invention, a compressive force of the damper space directly presses the push-out section forward, and the damper space is directly involved in protrusion and retraction of the writing tip.

Further, in the writing implement according to the fifth invention, pressure in the compressed damper space is used for pressing the push-out section forward. Thus, in order to assist rearward return operation of the knock section, for example, a bellows-shaped or coil-shaped elastic member may be inserted into the damper space.

(6) Sixth Invention

To achieve the above described object, a sixth invention of the present invention provides a writing implement including a knock mechanism capable of advancing a writing tip by push-out operation, comprising: a holding section for holding the writing tip; a shaft tube for containing the holding section; a knock section covered with a rear end portion of the shaft tube; a push-out section for pressing the holding section toward a front end in operative association with push-out operation of the knock section; and a damper space provided between the knock section and the shaft tube and sealed off from the outside; volume of the damper space being changed by the push-out operation of the knock section.

That is, the difference from the first invention is in a structure in which the knock section is inserted into the shaft tube. Even with such a structure, the knock section maintains a fixed position by air pressure in the damper space while the push-out operation is not performed, irrespective of whether the writing tip is protruded or retracted. Moreover, when the knock section is returned from a push-out position to its original position, impact is cushioned by the air pressure in the damper space.

The present invention is configured as described above, and thus can provide a writing implement including a knock mechanism, in which, without obstruction of normal operation, impact can be cushioned by a damper space that is sealed off from the outside.

Moreover, particularly when the damper space is provided between the knock section and the shaft tube, there is no particular need for increasing a length of a shaft for providing the damper space.

BEST MODE FOR CARRYING OUT THE INVENTION

Embodiments of the present invention are described below with reference to the drawings.

(1) First Embodiment

Figure 1:
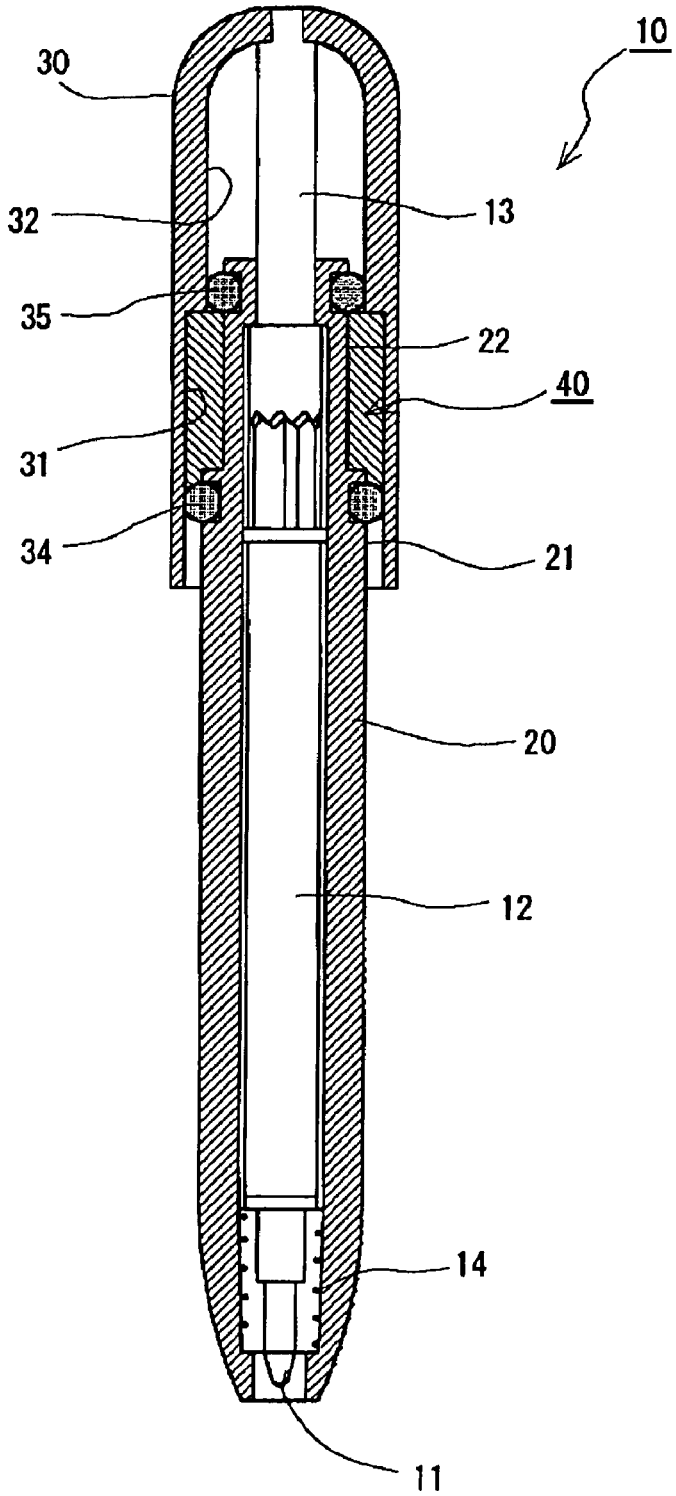
FIG. 1 illustrates a schematic partially sectional front view of a writing implement according to a first embodiment of the present invention.

FIG. 1 illustrates a schematic partially sectional front view of a writing implement 10 according to the first embodiment of the present invention.

In a shaft tube 20 is housed an ink-containing tube as a holding section 12 to which a ballpoint pen tip as a writing tip 11 is mounted. The ink-containing tube and the ballpoint pen tip constitute a replaceable ink refill.

A rear end of the shaft tube 20 is covered with a knock section 30. Moreover, a push-out section 13 that abuts against a rear end of the holding section 12 is provided from a rear end of an inner wall of the knock section 30 toward a front end. On the other hand, a spring 14 is provided between a front end of the ink-containing tube and a front end of an inner wall of the shaft tube 20.

A rear end portion of the shaft tube 20 has a reduced outer diameter. This portion is referred to as a reduced-diameter portion 22. Then, a portion of the shaft tube 20 before the reduced-diameter portion 22 is referred to as a base portion 21. Annular grooves are provided on outer peripheries near rear ends of the reduced-diameter portion 22 and the base portion 21, and O-rings of silicone rubber are fitted in the grooves. The O-ring fitted in the base portion 21 is referred to as a front-seal member 34, and the O-ring fitted in the reduced-diameter portion 22 is referred to as a rear-seal member 35.

In the inner wall of the knock section 30, its front half portion has a larger inner diameter than its rear half portion. The front half portion is referred to as a large-diameter portion 31, and the rear half portion is referred to as a small-diameter portion 32. More specifically, an inner diameter of the large-diameter portion 31 is slightly larger than an outer diameter of the base portion 21 of the shaft tube 20, and the front-seal member 34 is brought into tight contact with an inner periphery of the large-diameter portion 31. On the other hand, an inner diameter of the small-diameter portion 32 is slightly larger than an outer diameter of the reduced-diameter portion 22 of the shaft tube 20 and smaller than the outer diameter of the base portion 21, and the rear-seal member 35 is brought into tight contact with an inner periphery of the small-diameter portion 32. Thus, a space surrounded by the inner wall of the knock section 30, an outer wall of the shaft tube 20, the front-seal member 34, and the rear-seal member 35 is cut off from the outside. This space is referred to as a damper space 40. Further, a portion corresponding to the damper space 40 is illustrated as a hatched area in the figures.

Figure 2:
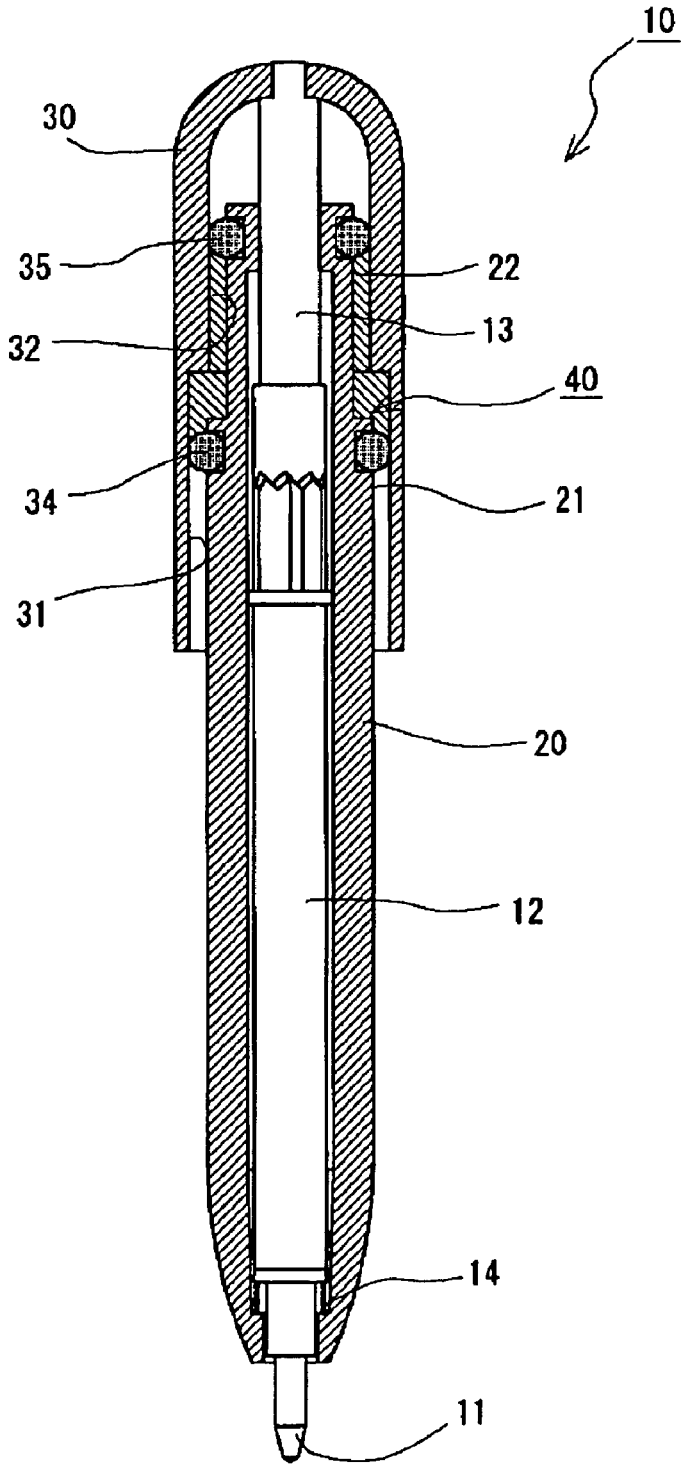
FIG. 2 illustrates a schematic partially sectional front view of operation of the writing implement according to the first embodiment of the present invention.

In this embodiment, when the rear end of the knock section 30 is pressed by a finger in a retraction state of the writing tip 11 as shown in FIG. 1, the push-out section 13 is moved toward the front end as shown in FIG. 2. Then, the holding section 12 is also moved toward the front end while compressing the spring 14, and the writing tip 11 is protruded from the front end of the shaft tube 20. The holding section 12 maintains this position by an unillustrated lock mechanism unless the knock section 30 is operated again. On the other hand, the inner wall of the knock section 30 is moved toward the front end while maintaining tight contact with the front-seal member 34 and the rear-seal member 35. This reduces the volume of the damper space 40 to increase internal pressure.

Figure 3:
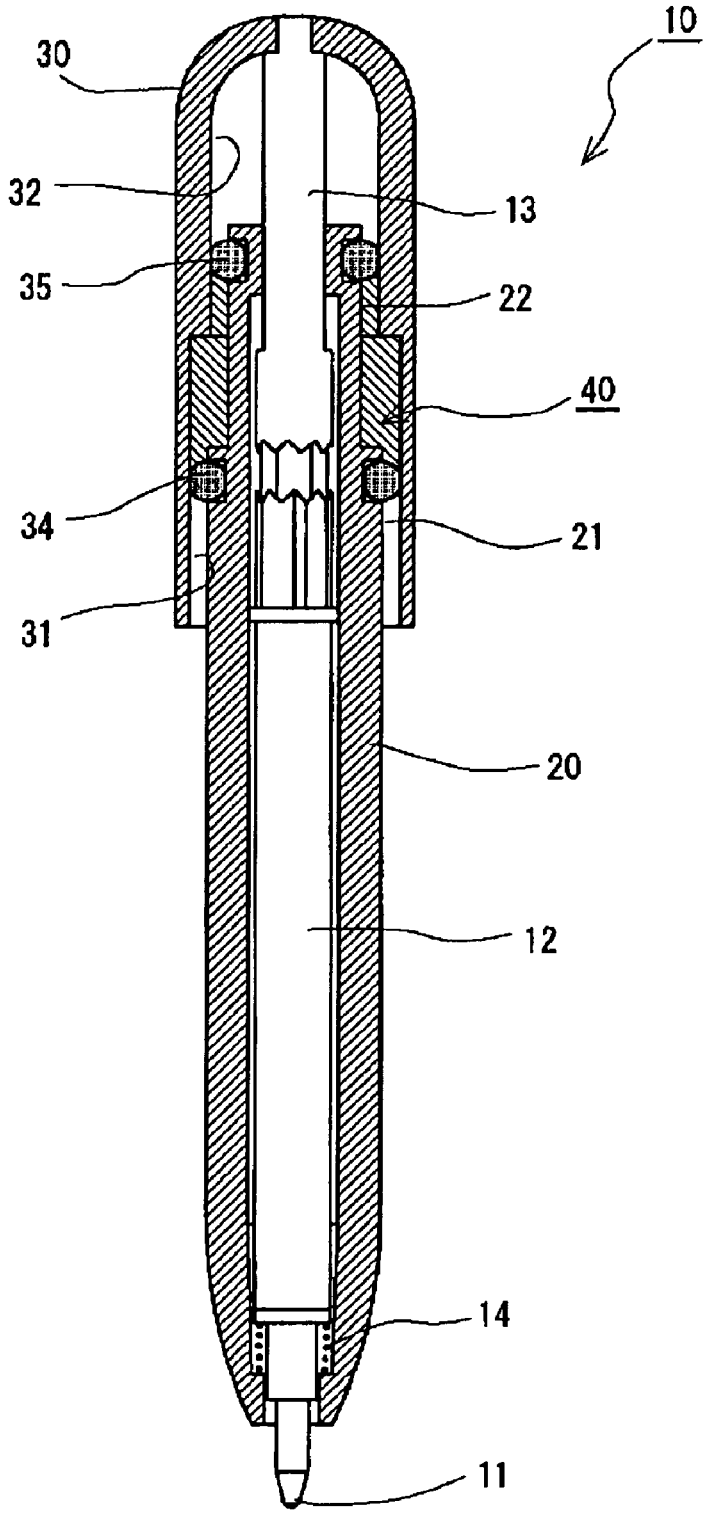
FIG. 3 illustrates a schematic partially sectional front view of operation of the writing implement according to the first embodiment of the present invention.

When the finger is moved off from the rear end of the knock section 30 to release the pressing, the knock section 30 is pressed rearward by the internal pressure of the damper space 40 as shown in FIG. 3. Then, finally, the knock section 30 is returned to its original position with the writing tip 11 being protruded as shown in FIG. 4.

Figure 4:
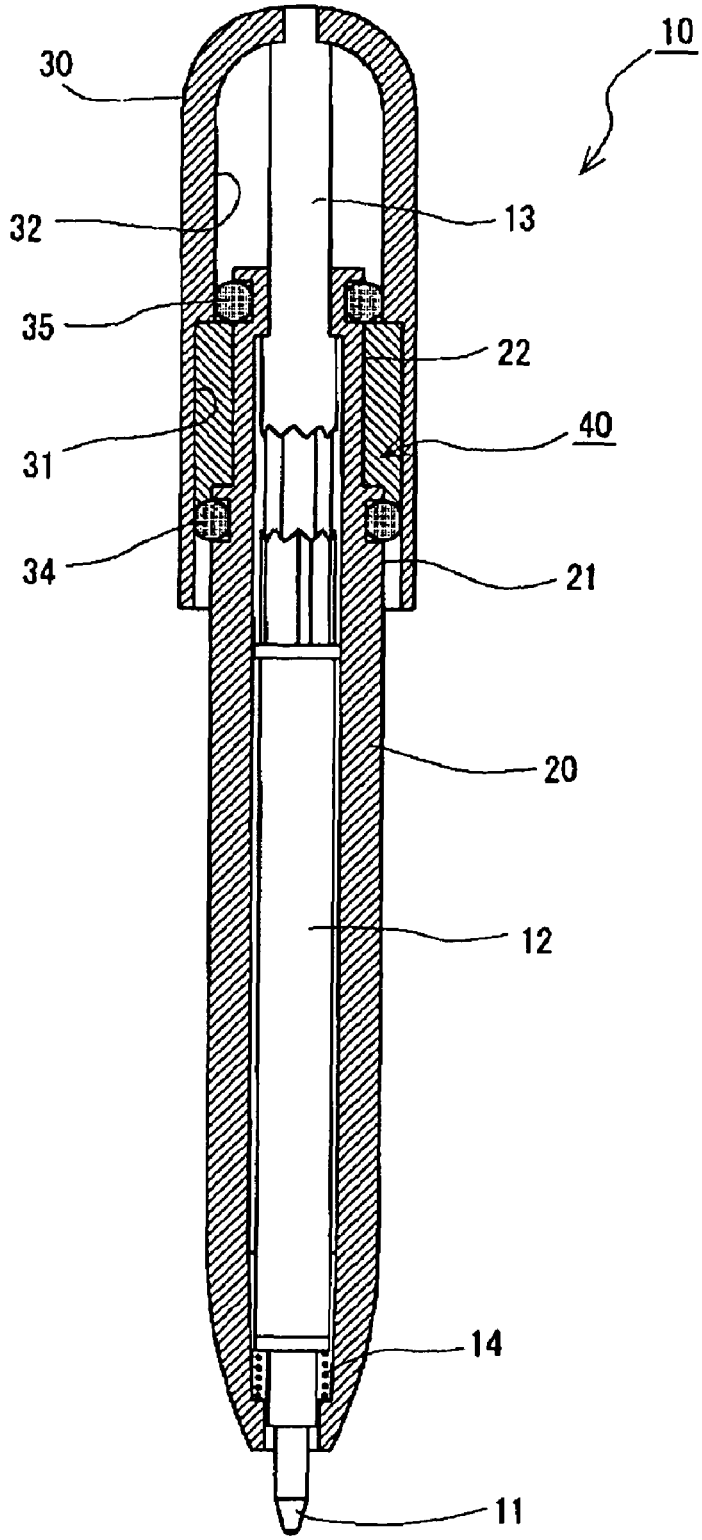
FIG. 4 illustrates a schematic partially sectional front view of operation of the writing implement according to the first embodiment of the present invention.
Figure 5:
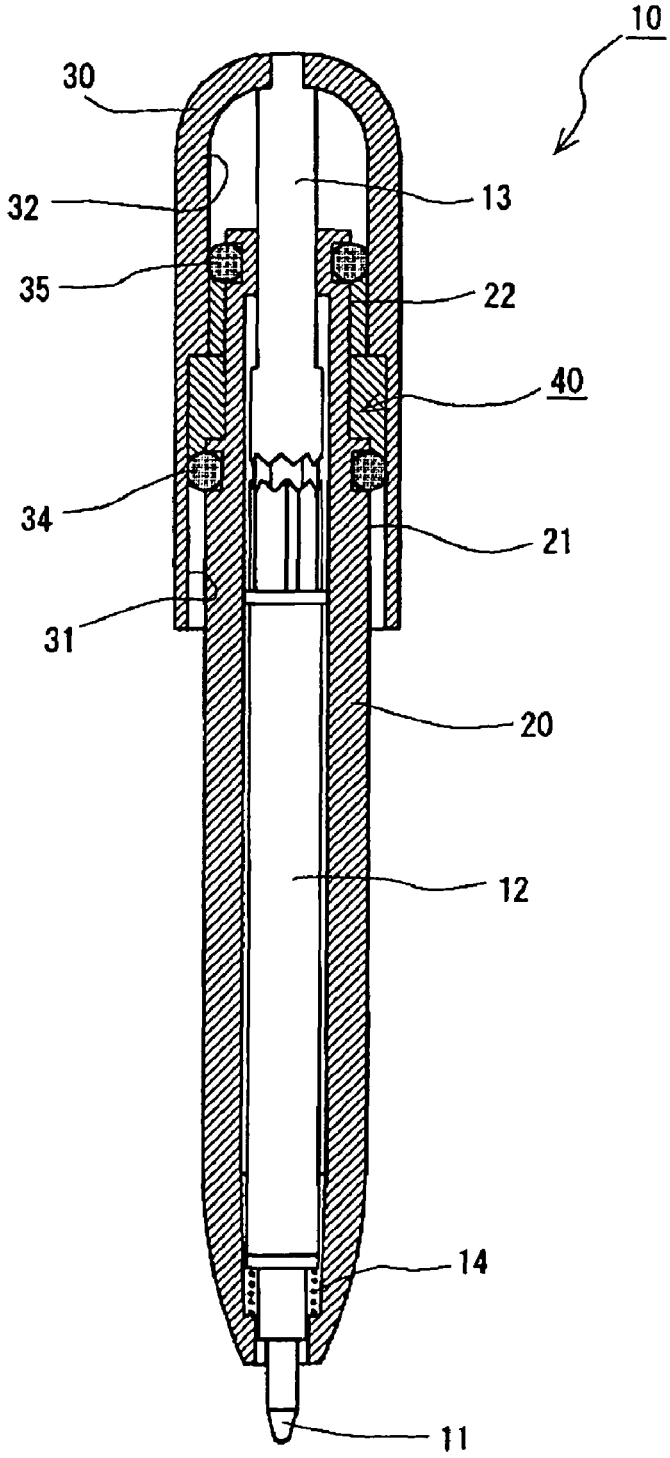
FIG. 5 illustrates a schematic partially sectional front view of operation of the writing implement according to the first embodiment of the present invention.
Figure 6:
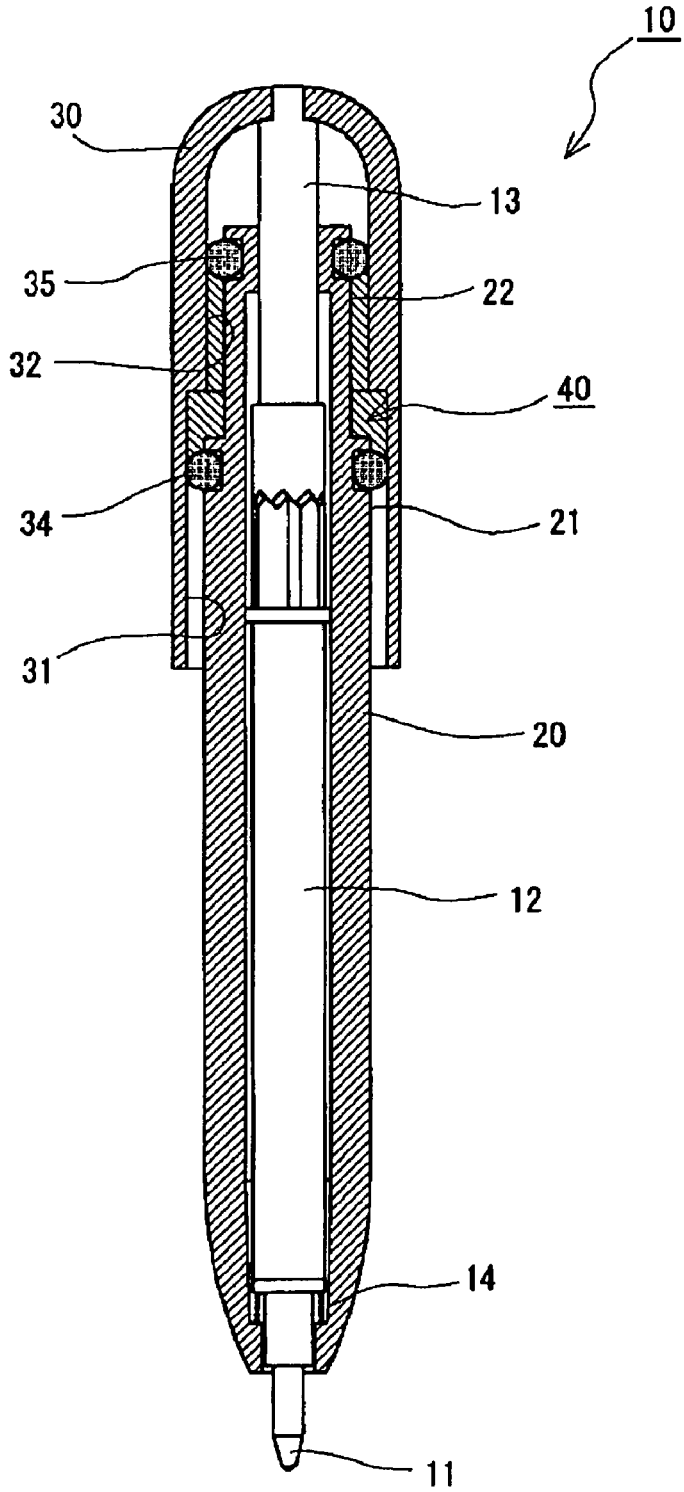
FIG. 6 illustrates a schematic partially sectional front view of operation of the writing implement according to the first embodiment of the present invention.
Figure 7:
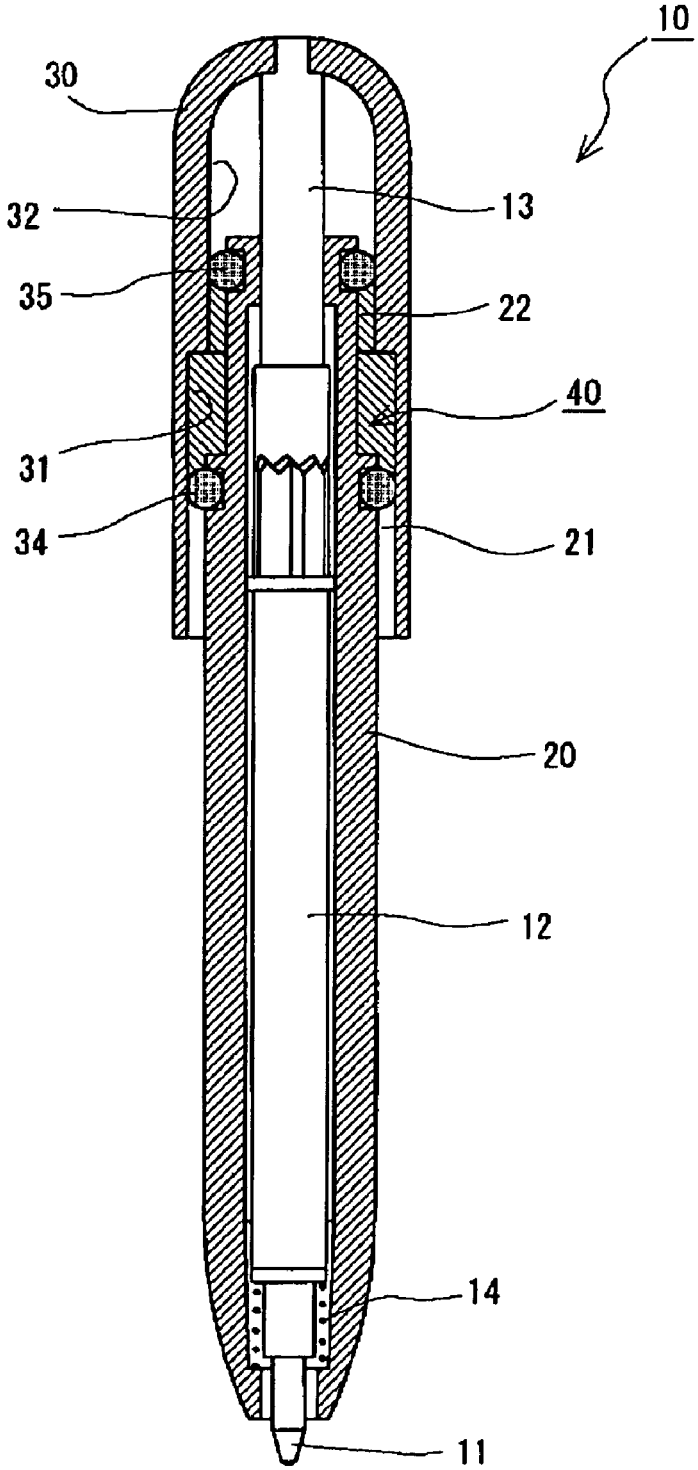
FIG. 7 illustrates a schematic partially sectional front view of operation of the writing implement according to the first embodiment of the present invention.

Next, when the rear end of the knock section 30 is pressed again by the finger in the state shown in FIG. 4, the push-out section 13 is moved toward the front end while compressing the damper space 40 as shown in FIG. 5. Then, when the push-out section 13 releases the unillustrated lock mechanism in the state shown in FIG. 6, the holding section 12 is pressed rearward by a biasing force of the spring 14 as shown in FIG. 7, and thus, the push-out section 13 and the knock section 30 are pressed rearward. However, the damper space 40 prevents sudden rearward movements and cushions the impact. Then, the writing tip 11 is completely retracted into the shaft tube 20, and returned to the state shown in FIG. 1.

(2) Second Embodiment

Figure 8:
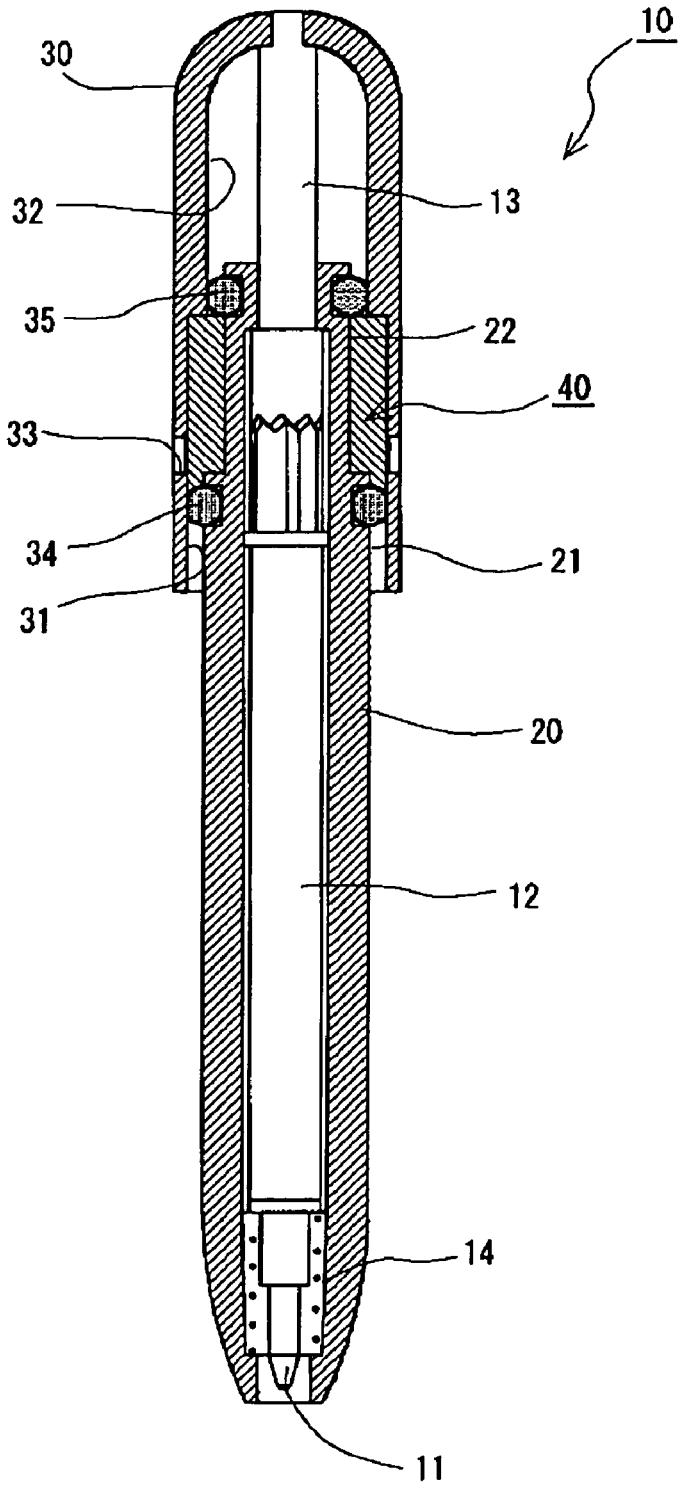
FIG. 8 illustrates a schematic partially sectional front view of a writing implement according to a second embodiment of the present invention.
Figure 9:
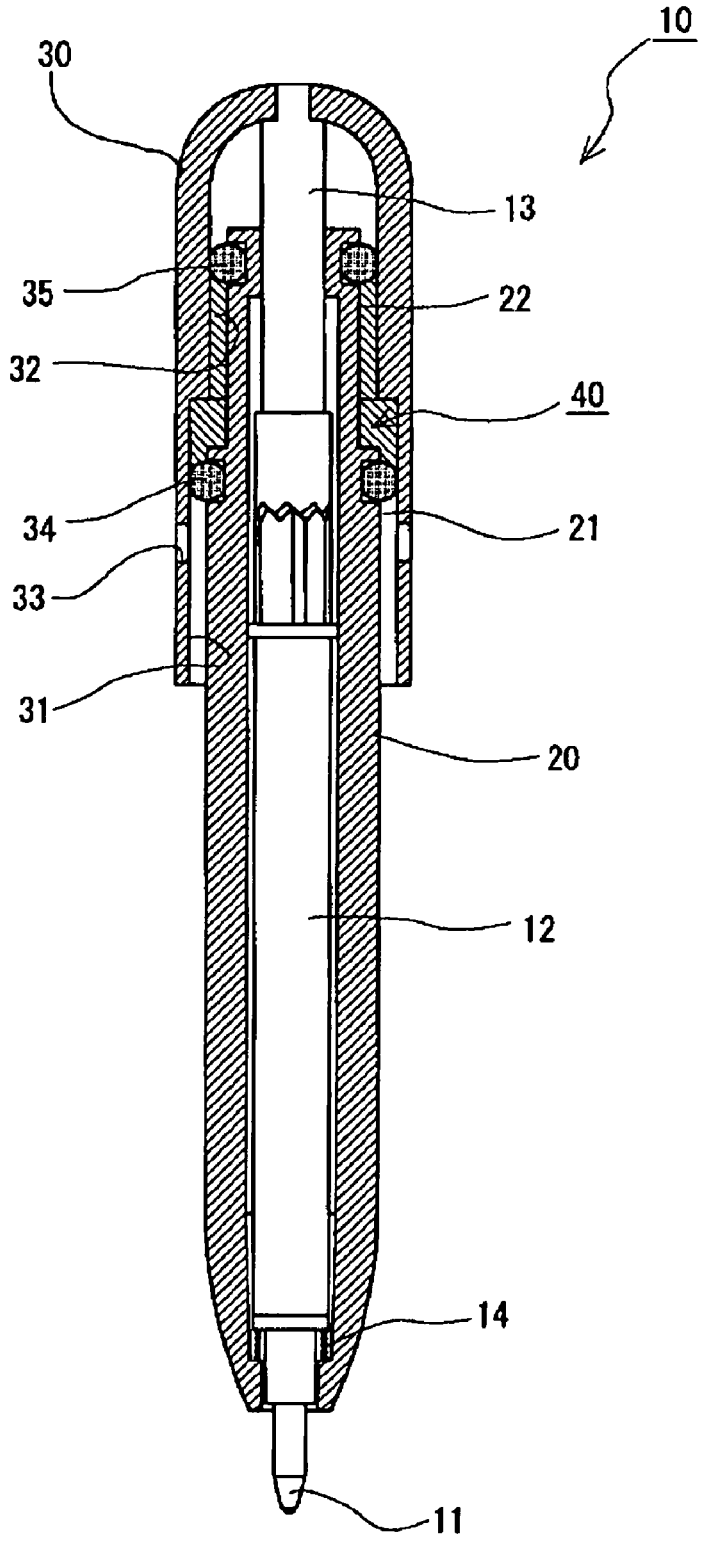
FIG. 9 illustrates a schematic partially sectional front view of operation of the writing implement according to the second embodiment of the present invention.

In the second embodiment, an air hole 33 is provided in a part of a knock section 30, and in a retraction state of a writing tip 11 shown in FIG. 8, a damper space 40 communicates with the outside through the air hole 33. However, when a rear end of the knock section 30 is pressed by a finger, the damper space 40 is sealed at the time when the hole is moved forward before a front-seal member 34 as shown in FIG. 9 to increase internal pressure. The operations thereafter are substantially the same as those in the first embodiment.

This configuration can prevent operation trouble of the knock section 30 due to a pressure difference between internal pressure of the damper space 40 and outside atmospheric pressure caused by changes in the outside atmospheric pressure.

(3) Third Embodiment

Figure 10:
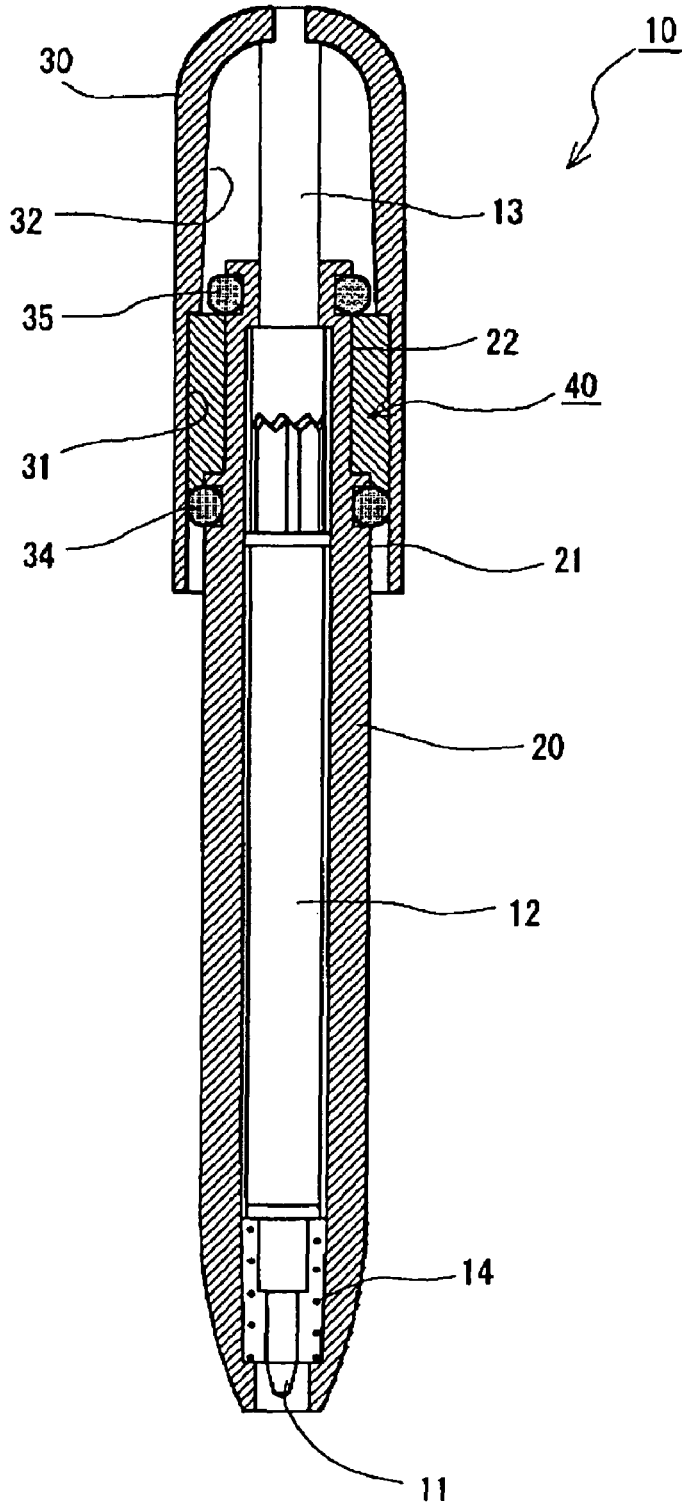
FIG. 10 illustrates a schematic partially sectional front view of a writing implement according to a third embodiment of the present invention.
Figure 11:
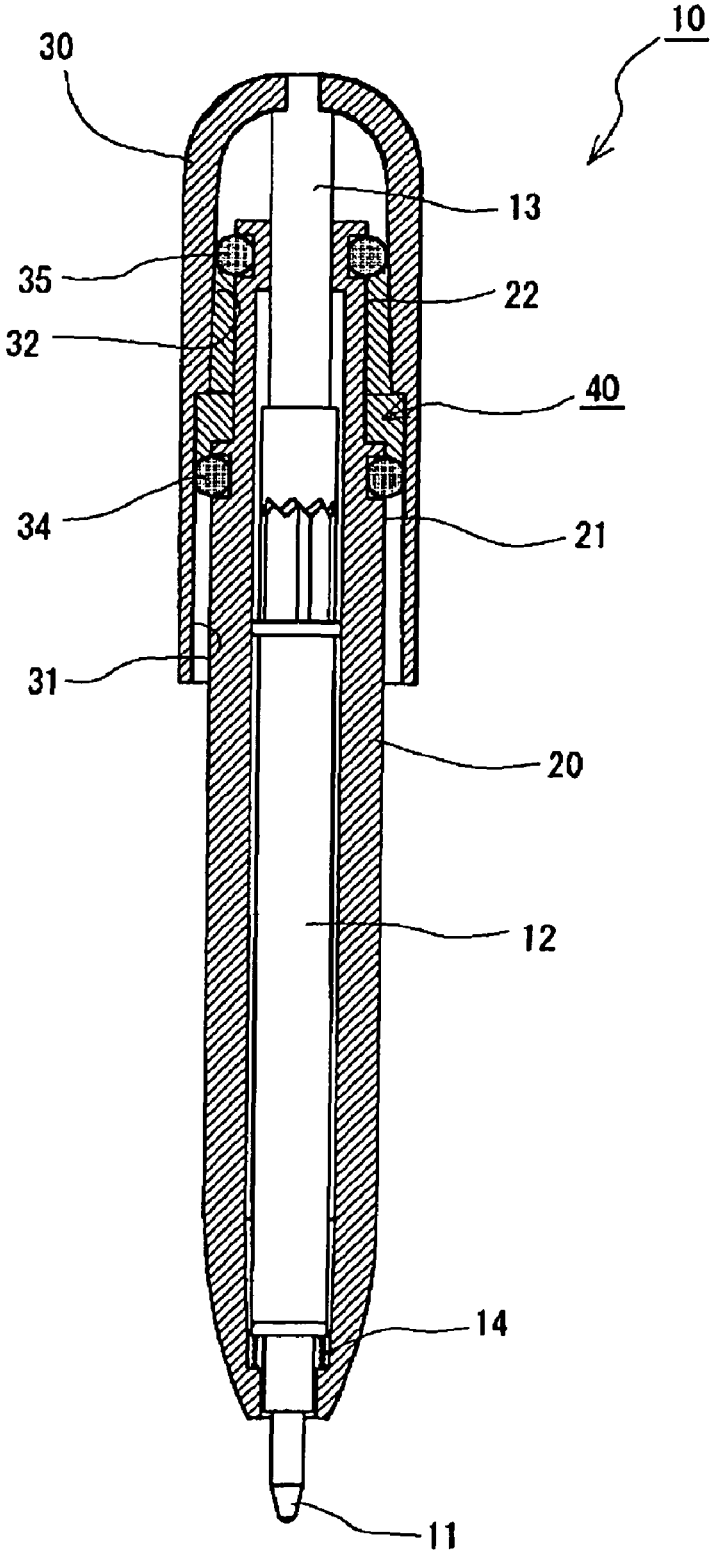
FIG. 11 illustrates a schematic partially sectional front view of operation of the writing implement according to the third embodiment of the present invention.

In the third embodiment, a small-diameter portion 32 of a knock section 30 is formed as a tapered surface to slightly expand toward a front end. In a retraction state of a writing tip 11 shown in FIG. 10, the small-diameter portion 32 is not in contact with a rear-seal member 35, and thus a damper space 40 is not cut off from the outside. However, when a rear end of the knock section 30 is pressed by a finger, the small-diameter portion 32 is gradually brought close to the rear-seal member 35 and finally brought into contact with the rear-seal member 35 as shown in FIG. 11, and then the damper space 40 is sealed. The operations thereafter are substantially the same as those in the first embodiment.

This configuration can prevent trouble caused by changes in outside atmospheric pressure as in the second embodiment, and also prevent sticking of the rear-seal member 35 when the writing implement is not used for a long time.

(4) Fourth Embodiment

Figure 12:
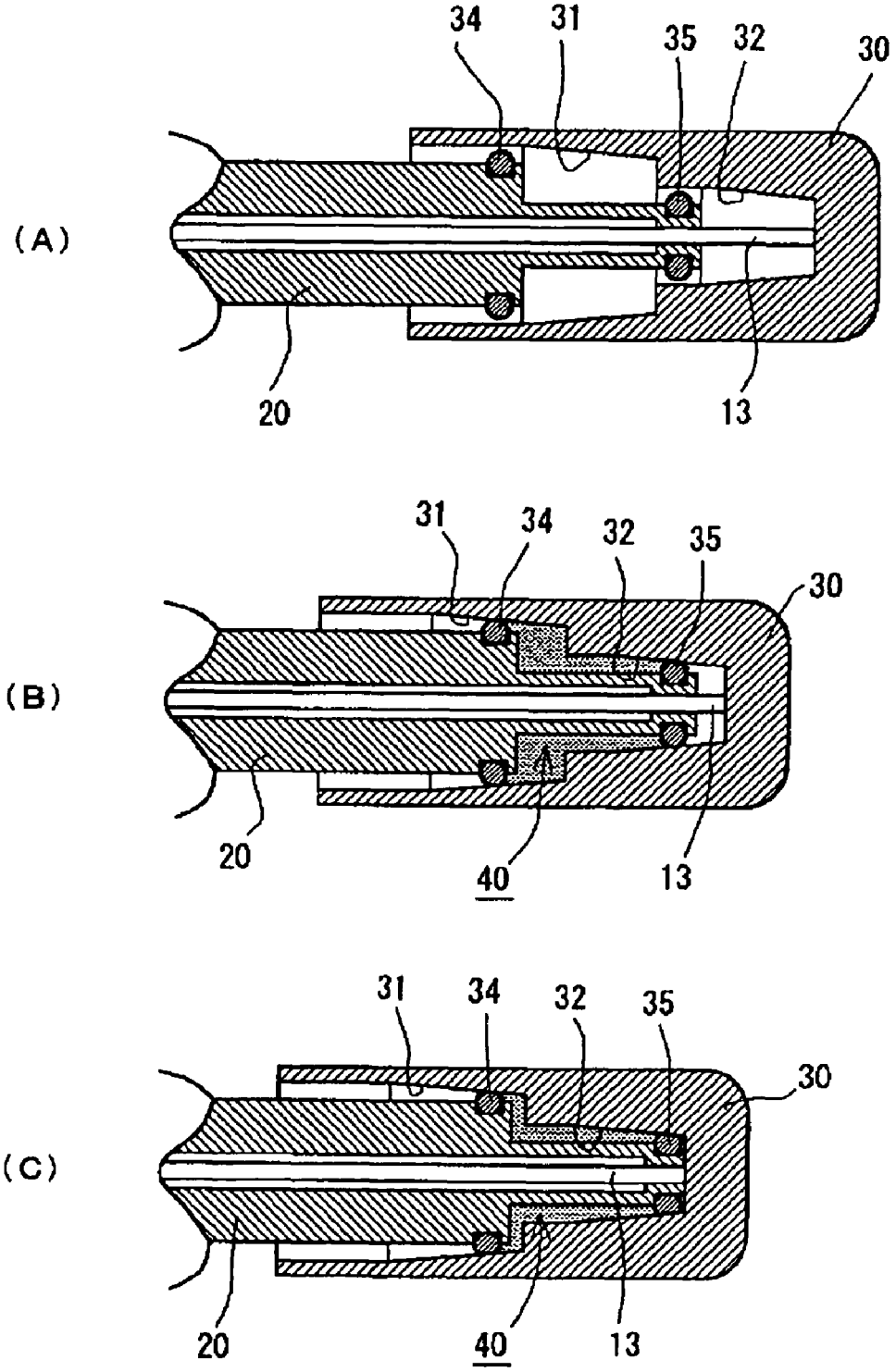
FIG. 12 illustrates a schematic partially sectional front view of operation of a writing implement according to a fourth embodiment of the present invention.

FIG. 12 illustrates a schematic front sectional view of essential parts of a writing implement 10 according to the fourth embodiment of the present invention.

In this embodiment, both a small-diameter portion 32 and a large-diameter portion 31 of a knock section 30 are formed as tapered surfaces to expand toward a front end. Thus, in a retraction state of a writing tip 11 shown in FIG. 12(A), the small-diameter portion 32 is not in contact with a rear-seal member 35, and the large-diameter portion 31 is not in contact with a front-seal member 34. Thus, a damper space 40 is not cut off from the outside. However, when a rear end of the knock section 30 is pressed by a finger, the small-diameter portion 32 is gradually brought close to the rear-seal member 35 and finally brought into contact with the rear-seal member 35 as shown in FIG. 12(B). Moreover, the large-diameter portion 31 is also gradually brought close to the front-seal member 34 and finally brought into contact with the front-seal member 34 as shown in FIG. 12(B). Then, the damper space 40 is sealed. Further pressing compresses the damper space 40 as shown in FIG. 12(C). The operations thereafter are substantially the same as those in the first embodiment.

This configuration can prevent trouble caused by changes in outside atmospheric pressure as in the second embodiment, and also prevent sticking of the rear-seal member 35 and the front-seal member 34 when the writing implement is not used for a long time.

(5) Fifth Embodiment

Figure 13:
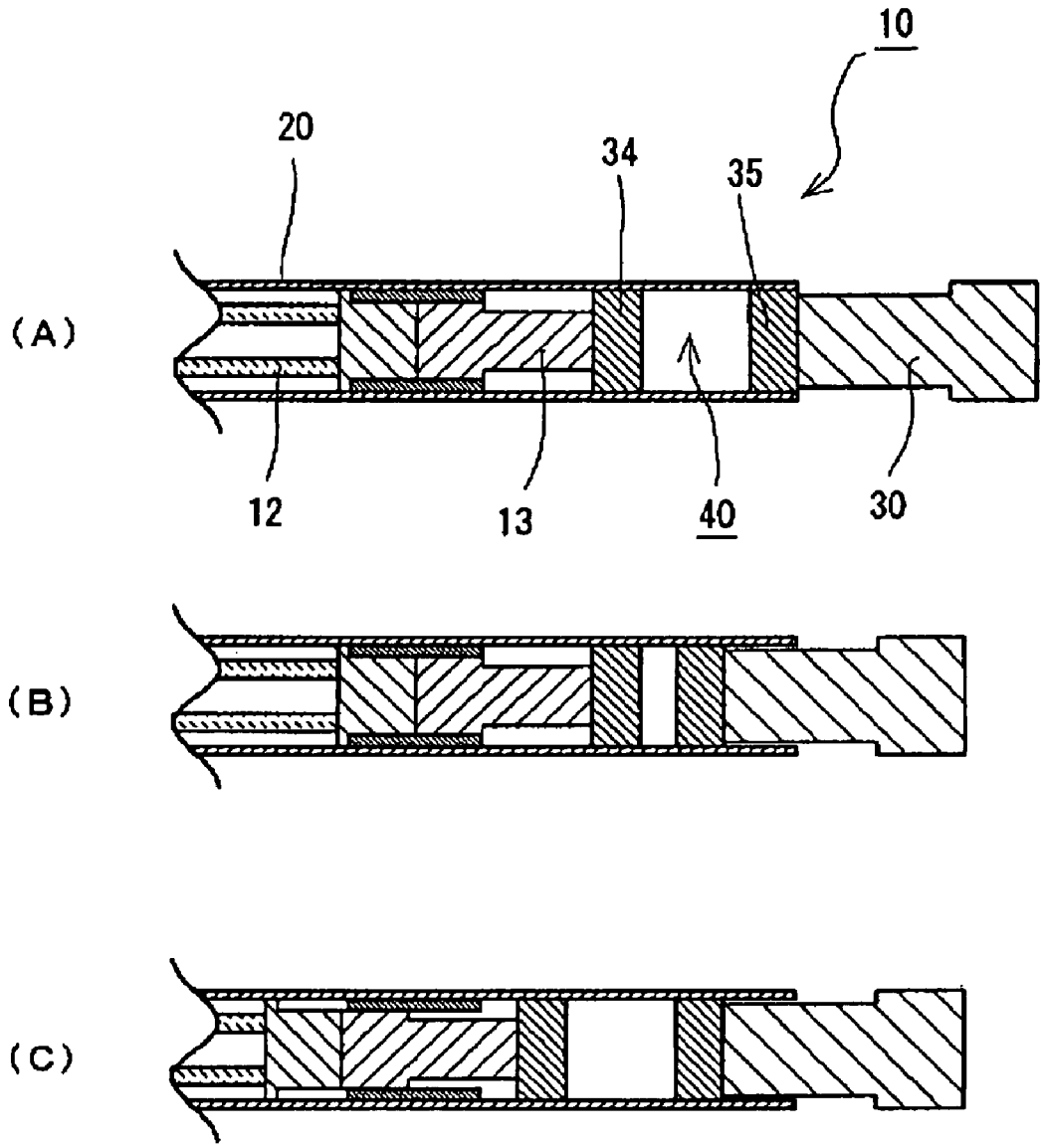
FIG. 13 illustrates a schematic partially sectional front view of operation of a writing implement according to a fifth embodiment of the present invention.

FIG. 13 illustrates a schematic front sectional view of essential parts of a writing implement 10 according to the fifth embodiment of the present invention.

In this embodiment, as shown in FIG. 13(A), a damper space 40 is provided between a knock section 30 located at a rear end of a shaft tube 20 and a push-out section 13 that abuts against a holding section 12 of an unillustrated writing tip 11. That is, a rear-seal member 35 provided at a front end of the knock section 30 is sealed against the shaft tube 20 at a rear end of the damper space 40, while a front-seal member 34 provided at a rear end of the push-out section 13 is sealed against the shaft tube 20, thereby forming the damper space 40 between the rear-seal member 35 and the front-seal member 34.

In this embodiment, when a rear end of the knock section 30 is pressed by a finger in a state shown in FIG. 13(A), the damper space 40 is compressed as shown in FIG. 13(B). Next, the damper space 40 is expanded to press the push-out section 13 forward as shown in FIG. 13(C) and move the holding section 12 forward, and thus the unillustrated writing tip 11 is protruded from a front end of the shaft tube 20.

(6) Sixth Embodiment

Figure 14:
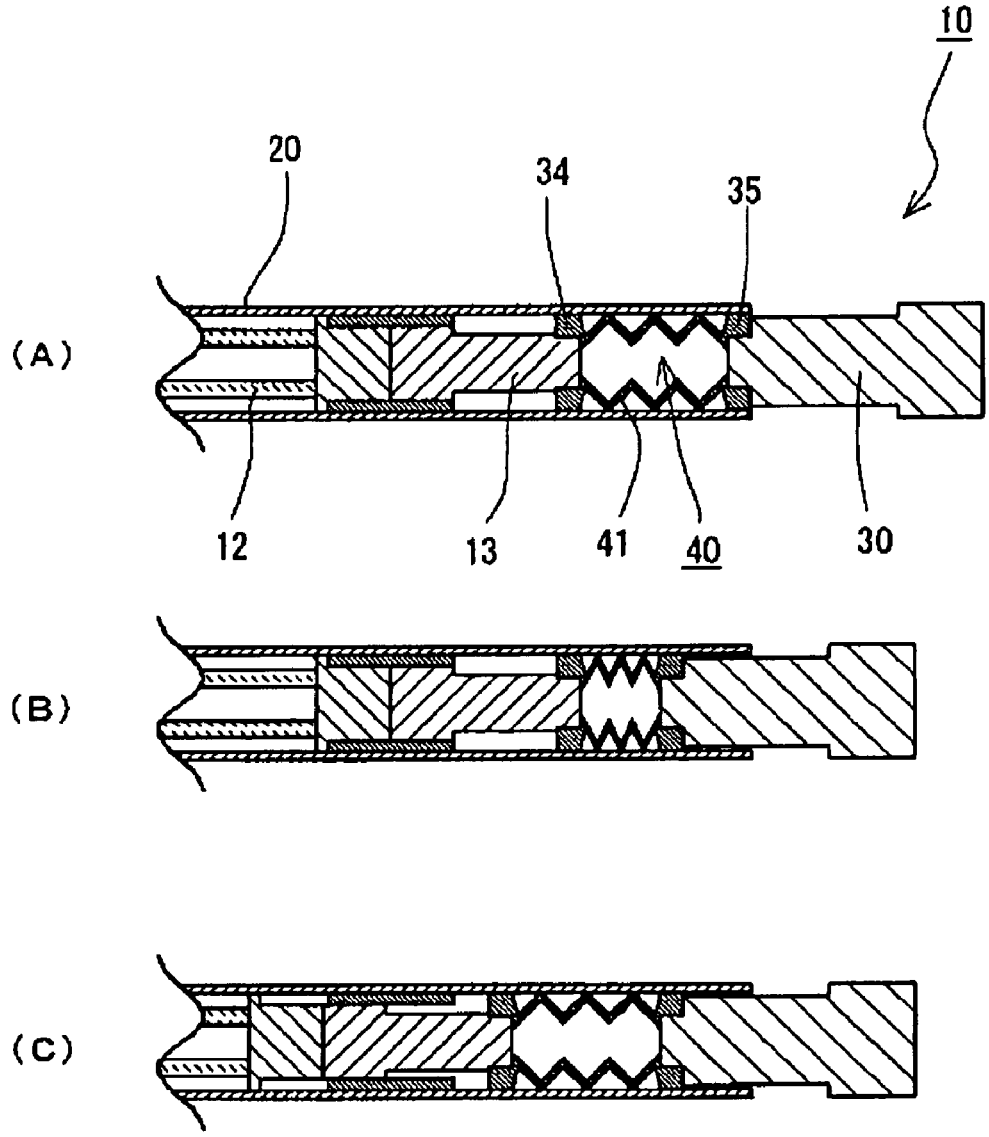
FIG. 14 illustrates a schematic partially sectional front view of operation of a writing implement according to a sixth embodiment of the present invention.

FIG. 14 illustrates a schematic front sectional view of essential parts of a writing implement 10 according to the sixth embodiment of the present invention.

In this embodiment, as shown in FIG. 14(A), a damper space 40 is provided between a knock section 30 located at a rear end of a shaft tube 20 and a push-out section 13 that abuts against a holding section 12 of an unillustrated writing tip 11. That is, a rear-seal member 35 provided at a front end of the knock section 30 is sealed against the shaft tube 20 at a rear end of the damper space 40, while a front-seal member 34 provided at a rear end of the push-out section 13 is sealed against the shaft tube 20, thereby forming the damper space 40 between the rear-seal member 35 and the front-seal member 34.

Furthermore, in the damper space 40, a bellows-shaped auxiliary elastic member 41 is provided between the front end of the knock section 30 and the rear end of the push-out section 13 to connect them.

In this embodiment, when a rear end of the knock section 30 is pressed by a finger in a state shown in FIG. 14(A), the damper space 40 is compressed and the auxiliary elastic member 41 is also compressed as shown in FIG. 14(B). Next, the damper space 40 is expanded and the auxiliary elastic member 41 is returned to press the push-out section 13 forward as shown in FIG. 14(C) and move the holding section 12 forward, and thus an unillustrated writing tip 11 is protruded from a front end of the shaft tube 20.

(7) Seventh Embodiment

Figure 15:
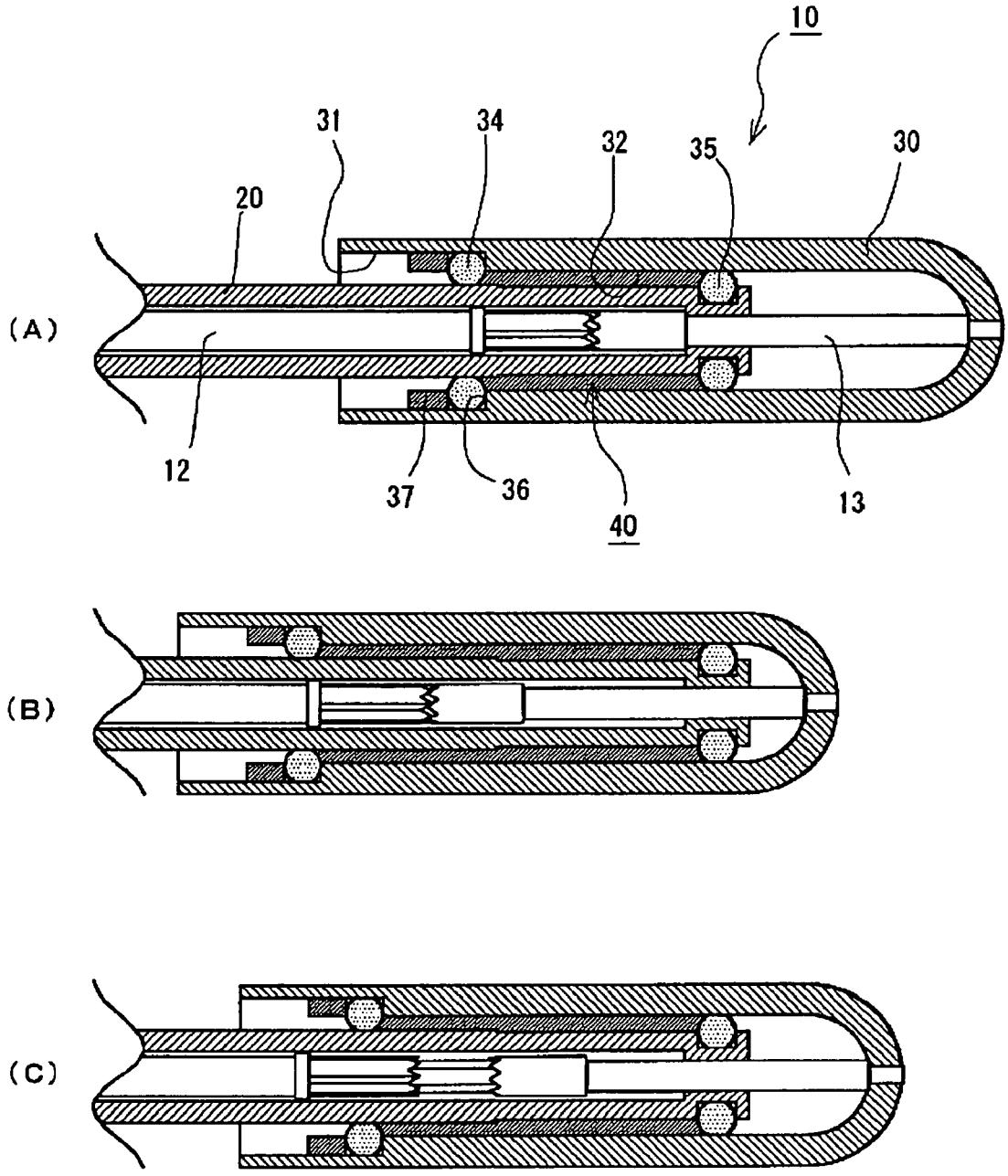
FIG. 15 illustrates a schematic partially sectional front view of operation of a writing implement according to a seventh embodiment of the present invention.

FIG. 15 illustrates a schematic front sectional view of essential parts of a writing implement 10 according to the seventh embodiment of the present invention.

A rear end of a shaft tube 20 is covered with a knock section 30 as in the first embodiment. Then, an annular groove is provided on an outer periphery at a rear end of a shaft tube 20, an O-ring of silicone rubber is fitted in the groove, and the O-ring is a rear-seal member 35 brought into contact with an inner wall of the knock section 30, as in the first embodiment.

In the inner wall of the knock section 30, its front half portion has a larger inner diameter than its rear half portion. The front half portion is referred to as a large-diameter portion 31, and the rear half portion is referred to as a small-diameter portion 32. The small-diameter portion 32 is brought into contact with the rear-seal member 35. On the other hand, an O-ring of silicone rubber is fitted in contact with a step 36 formed between the small-diameter portion 32 and the large-diameter portion 31, and a front end side of the O-ring is secured by a ring member 37. This O-ring is a front-seal member 34 and sealed against the shaft tube 20.

Also in this embodiment, as shown in FIG. 15(A), a damper space 40 is defined by the inner wall of the knock section 30, an outer wall of the shaft tube 20, the front-seal member 34, and the rear-seal member 35 as in the first embodiment, and the difference is that the front-seal member 34 is provided on the knock section 30. According to the difference, pressing of the knock section 30 expands the damper space 40.

That is, in this embodiment, when a rear end of the knock section 30 is pressed by a finger in a state shown in FIG. 15(A), the damper space 40 is expanded as shown in FIG. 15(B). This reduces internal pressure of the damper space 40. Then, the pressing of the knock section 30 causes a push-out section 13 to move a holding section 12 toward a front end, and thus an unillustrated writing tip 11 is protruded from a front end of a shaft tube 20 as in the first embodiment.

Then, when the finger is moved off from the rear end of the knock section 30 to release the pressing in the state shown in FIG. 15(B), outside atmospheric pressure applies a force to increase internal pressure of the damper space 40 to reduce the damper space 40 as shown in FIG. 15(C), and thus the knock section 30 is returned to its original position.

(8) Eighth Embodiment

Figure 16:
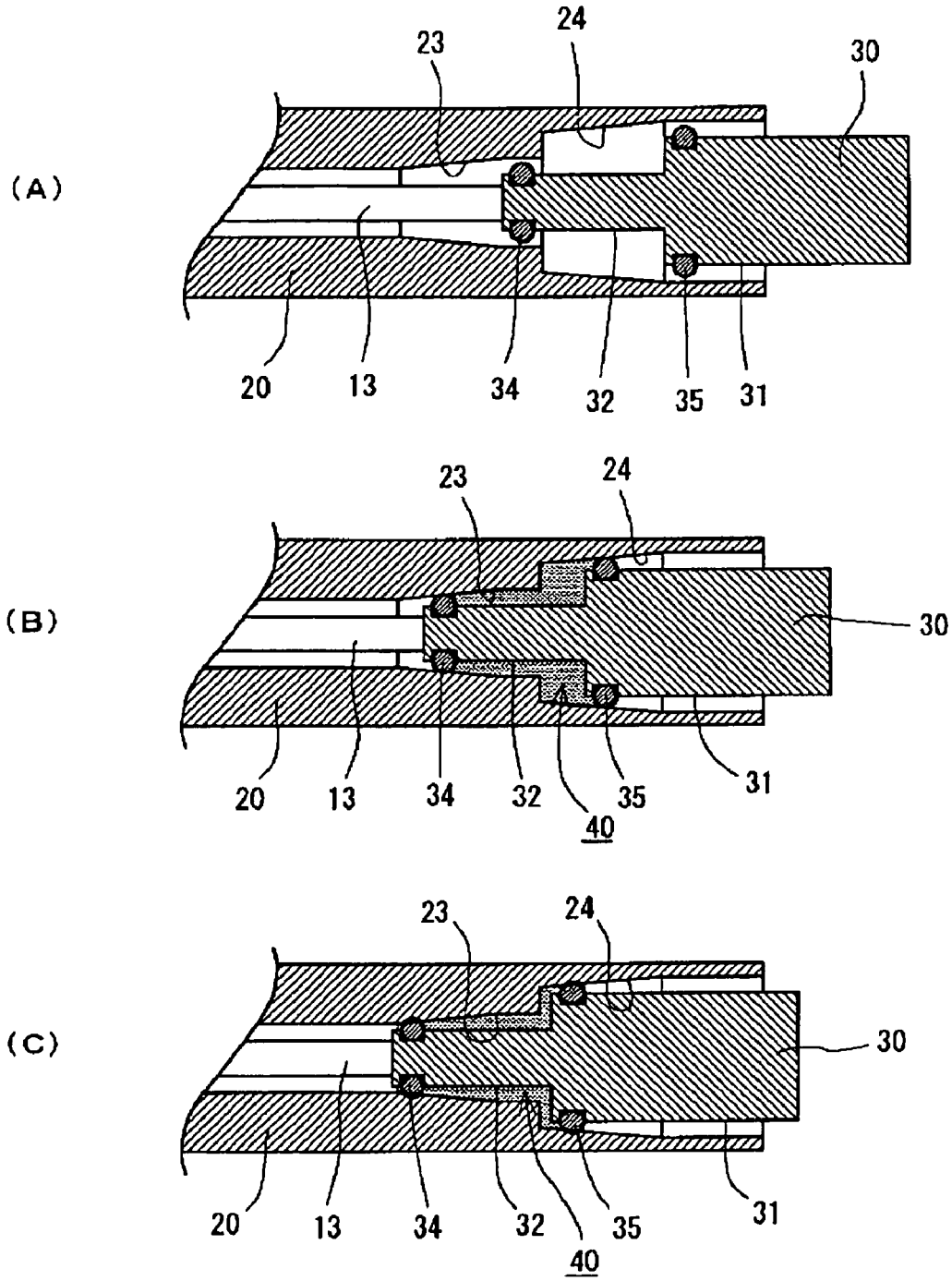
FIG. 16 illustrates a schematic partially sectional front view of operation of a writing implement according to an eighth embodiment of the present invention.

FIG. 16 illustrates a schematic front sectional view of essential parts of a writing implement 10 according to an eighth embodiment of the present invention.

In a shaft tube 20 is housed an ink-containing tube as a holding section 12 to which a ballpoint pen tip as a writing tip 11 is mounted (not shown) as in the first embodiment.

A knock section 30 is inserted into a rear end of the shaft tube 20. Moreover, a push-out section 13 that abuts against a rear end of the unillustrated holding section 12 is provided from a front end of an inner wall of the knock section 30 toward a front end of the shaft tube 20. On the other hand, a spring 14 (not shown) is provided between a front end of the ink-containing tube and a front end of an inner wall of the shaft tube 20.

The inner wall of the shaft tube 20 is tapered to have a gradually increased diameter near the rear end and, intervened by a step portion, further tapered to the rear end. A tapered surface before the step portion is referred to as a front tapered surface 23, and a tapered surface behind the step portion is referred to as a rear tapered surface 24.

In an outer wall of the knock section 30, a front half portion has a smaller inner diameter than a rear half portion. The front half portion is referred to as a small-diameter portion 32, and the rear half portion is referred to as a large-diameter portion 31. More specifically, an outer diameter of the small-diameter portion 32 is slightly smaller than an inner diameter of the front tapered surface 23 of the shaft tube 20. On the other hand, an outer diameter of the large-diameter portion 31 is slightly larger than the inner diameter of the front tapered surface 23 of the shaft tube 20, and smaller than an inner diameter of the rear tapered surface 24.

Annular grooves are provided on outer peripheries near front ends of the small-diameter portion 32 and the large-diameter portion 31, and O-rings of silicone rubber are fitted in the grooves. The O-ring fitted in the small-diameter portion 32 is referred to as a front-seal member 34, and the O-ring fitted in the large-diameter portion 31 is referred to as a rear-seal member 35.

In this embodiment, in a retraction state of the unillustrated writing tip 11, the front-seal member 34 is not in contact with the front tapered surface 23, and the rear-seal member 35 is not in contact with the rear tapered surface 24 as shown in FIG. 16(A).

When a rear end of the knock section 30 is pressed by a finger in this state, the front-seal member 34 is brought into contact with the front tapered surface 23 and the rear-seal member 35 is brought into contact with the rear tapered surface 24 as shown in FIG. 16(B). A damper space 40 illustrated as a hatched area is now formed. Further pressing reduces the volume of the damper space 40 as shown in FIG. 16(C) to increase internal pressure. The operations thereafter are substantially the same as those in the first embodiment.

INDUSTRIAL APPLICABILITY

The present invention is applicable to a retractable writing implement capable of protruding and retracting its writing tip, such as a ballpoint pen or a mechanical pencil.

The invention claimed is:

1. A writing implement including a knock mechanism capable of advancing a writing tip by push-out operation, comprising:

a holding section for holding the writing tip;

a shaft tube for containing the holding section;

a knock section for covering a rear end portion of the shaft tube;

a push-out section for pressing the holding section toward a front end in operative association with push-out operation of the knock section; and a damper space being provided between the knock section and the shaft tube and sealed off from the outside;

volume of the damper space being reduced by the push-out operation of the knock section, wherein:

the rear end portion of the shaft tube is formed as a reduced-diameter portion having a reduced outer diameter;

the knock section is shaped to cover the rear end portion of the shaft tube;

a front half portion of an inner space of the knock section is formed as a large-diameter portion having a larger inner diameter;

a rear half portion of the inner space of the knock section is formed as a small-diameter portion having a smaller inner diameter;

the push-out section is protruded from a rear end surface of the small-diameter portion of the knock section;

the push-out section passes through the reduced-diameter portion to abut against the holding section;

the inner diameter of the large-diameter portion is formed to be slightly larger than an outer diameter of a base portion which consists a front side portion of the shaft tube before the reduced-diameter portion;

the inner diameter of the small-diameter portion is formed to be slightly larger than the outer diameter of the reduced-diameter portion of the shaft tube and smaller than the outer diameter of the base portion, a front-seal member that seals a clearance between the base portion and the large-diameter portion is mounted to an outer periphery of the base portion, a rear-seal member that seals a clearance between the reduced-diameter portion and the small-diameter portion is mounted to an outer periphery of the reduced-diameter portion, and a clearance between the large-diameter portion and the reduced-diameter portion is cut off from the outside by the front-seal member and the rear-seal member to form the damper space.

2. The writing implement according to claim 1, wherein at least one of the small-diameter portion and the large-diameter portion is formed as a tapered surface having a larger inner diameter on a front end side than that on a rear end side, and at least one of the rear-seal member and the front-seal member is brought into tight contact with a smaller diameter portion of the tapered surface by the push-out operation of the knock section.

3. The writing implement according to claim 1, wherein the knock section has an air hole that provides communication between the damper space and the outside when the push-out operation of the knock section is not performed, and the air hole is moved toward a front end side before the front-seal member by the push-out operation of the knock section, and thus the damper space is sealed off from the outside.

* * * * *